US009592677B2

(12) United States Patent
Kayahara

(10) Patent No.: US 9,592,677 B2
(45) Date of Patent: Mar. 14, 2017

(54) DOT RECORDING APPARATUS, DOT RECORDING METHOD, COMPUTER PROGRAM THEREFOR, AND METHOD OF MANUFACTURING RECORDING MEDIUM

(71) Applicant: SEIKO EPSON CORPORATION, Tokyo (JP)

(72) Inventor: Naoki Kayahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/828,865

(22) Filed: Aug. 18, 2015

(65) Prior Publication Data

US 2016/0129710 A1 May 12, 2016

(30) Foreign Application Priority Data

Nov. 10, 2014 (JP) ..... 2014-227761

(51) Int. Cl.
*B41J 2/21* (2006.01)

(52) U.S. Cl.
CPC ..... *B41J 2/2132* (2013.01)

(58) Field of Classification Search
CPC ..... B41J 2/2132
See application file for complete search history.

(56) References Cited

U.S. PATENT DOCUMENTS 5,633,663 A 5/1997 Matsubara et al.
5,992,962 A * 11/1999 Yen ..... B41J 2/2132 347/12
7,907,307 B2 3/2011 Yamazaki
7,948,652 B2 5/2011 Noguchi et al.
8,786,896 B2 * 7/2014 Marumoto ..... G06K 15/1874 358/1.2
2009/0073203 A1 * 3/2009 Takekoshi ..... B41J 2/2114 347/9
2015/0015626 A1 * 1/2015 Kayahara ..... B41J 2/2132 347/9

FOREIGN PATENT DOCUMENTS

JP 06-022106 A 1/1994
JP 2002-036515 A 2/2002
JP 2007-306550 A 11/2007
JP 2008-092191 A 4/2008
JP 2013-256003 A 12/2013
JP 2014-200971 A 10/2014
JP 2015-016671 A 1/2015

* cited by examiner

*Primary Examiner* — Jason Uhlenhake
(74) *Attorney, Agent, or Firm* — Global IP Counselors, LLP

(57) ABSTRACT

A dot recording apparatus forms dots on a recording medium while relatively moving a recording head that includes a plurality of nozzles and the recording medium in a main scanning direction. The dot recording apparatus performs multi-pass recording in which dot recording on a main scanning line is completed by a plurality of main scanning passes. In dot recording in each main scanning pass, the dot recording is performed using a plurality of super cell regions that include m types of super cell regions having different sizes, the super cell region being formed as one dot group by some of the plurality of nozzles and having a boundary line portion which is not parallel to either the main scanning direction or a sub-scanning direction that intersects the main scanning direction in at least a portion of a boundary line between the super cell region and another super cell region.

10 Claims, 13 Drawing Sheets

● : DOT OF UC1
(RECORDING IS PERFORMED BY ODD-NUMBERED PASS)

○ : DOT OF UC2
(RECORDING IS PERFORMED BY EVEN-NUMBERED PASS)

DOT RECORDING APPARATUS, DOT RECORDING METHOD, COMPUTER PROGRAM THEREFOR, AND METHOD OF MANUFACTURING RECORDING MEDIUM

CROSS-REFERENCE TO RELATED APPLICATIONS

This application claims priority to Japanese Patent Application No. 2014-227761 filed on Nov. 10, 2014. The entire disclosure of Japanese Patent Application No. 2014-227761 is hereby incorporated herein by reference.

BACKGROUND

1. Technical Field

The present invention relates to a dot recording apparatus, a dot recording method, a computer program therefore, and a method of manufacturing a recording medium.

2. Related Art

A printer that reciprocates a plurality of recording heads ejecting different colors of ink with respect to a recording material and performs printing by performing main scanning during the forward movement and backward movement thereof has been known as a dot recording apparatus (for example, JP-A-6-22106). In the printer, pixel groups each of which is constituted by m×n pixels are arrayed within a printable region through one main scanning operation so as not to be adjacent to each other. In addition, recording is completed by performing main scanning plural times using a plurality of thinning patterns having an arrangement that is mutually complementary.

However, in the above-mentioned printer of the related art, each of the pixel groups has a rectangular shape, and the boundary line thereof is constituted by a side parallel to a main scanning direction and a side parallel to a sub-scanning direction. Accordingly, an elongated boundary line extending in the main scanning direction and an elongated boundary line extending in the sub-scanning direction are formed by a set of boundary lines of the adjacent pixel groups. For this reason, there is a tendency for banding (image quality deterioration region) to be generated along the elongated boundary lines, which results in a problem of being conspicuousness. In addition, when the pixel groups are complicated, there is a problem in that a significant memory capacity for specifying the pixel groups is required.

Such a problem is not limited to the printer, and is also common to dot recording apparatuses that record dots on a recording medium (dot recording medium).

SUMMARY

The invention can be realized in the following forms or application examples.

(1) According to an aspect of the invention, a dot recording apparatus is provided. The dot recording apparatus includes a recording head that includes a plurality of nozzles; a main scanning driving mechanism that performs a main scanning pass for forming dots on a recording medium while relatively moving the recording head and the recording medium in a main scanning direction; a sub-scanning driving mechanism that performs sub-scanning for relatively moving the recording medium and the recording head in a sub-scanning direction that intersects the main scanning direction; and a control unit. The control unit performs multi-pass recording in which dot recording on a main scanning line is completed by N main scanning passes (N is a predetermined integer of 2 or greater). In dot recording in each main scanning pass, the dot recording is performed using a plurality of super cell regions that include m types (m is an integer of 2 or greater) of super cell regions having different sizes, the super cell region being formed as one dot group by some of the plurality of nozzles and having a boundary line portion which is not parallel to either the main scanning direction or the sub-scanning direction in at least a portion of a boundary line between the super cell region and another super cell region. According to the dot recording apparatus of this aspect, at least a portion of the boundary line of each of the individual super cell regions has a boundary line portion which is not parallel to either the main scanning direction or the sub-scanning direction, and thus it is possible to make banding less likely to be conspicuous, as compared to a case where the boundary line is constituted by only a boundary line parallel to the main scanning direction and a boundary line parallel to the sub-scanning direction. In addition, since the super cell regions have a plurality of types of sizes, it is possible to make the presence of the super cell regions less likely to be conspicuous.

(2) In the dot recording apparatus of the aspect, the m types of super cell regions may include p smallest super cell regions (p is an integer of 1 or greater and has a value varying depending on a type of super cell region) on the basis of the smallest super cell region formed as one dot group by some of the plurality of nozzles. According to the dot recording apparatus of this aspect, it is possible to reduce the size of the memory required for specifying the super cell regions.

(3) In the dot recording apparatus of the aspect, in dot recording in each main scanning pass, some of the plurality of super cell regions recorded in the same main scanning pass may be formed by connecting masses of a plurality of dots, which have similar shapes and are recorded in the main scanning pass, to each other. According to the dot recording apparatus of this aspect, it is possible to reduce the size of a memory for specifying the super cell regions.

(4) In the dot recording apparatus of the aspect, the super cell regions may include a first super cell region and a second super cell region that overlap each other at mutual boundaries. According to the dot recording apparatus of this aspect, two super cell regions overlap each other, and thus it is possible to make banding less likely to be conspicuous.

(5) In the dot recording apparatus of the aspect, when the first super cell region is recorded by a first main scanning pass and the second super cell region is recorded by a second main scanning pass which is subsequent to the first main scanning pass, a ratio in charge of dot recording which is a ratio of the number of pixel positions at which dot recording is performed, as pixel positions belonging to the first super cell region, to the number of pixel positions at which dot recording is performed as pixel positions belonging to the second super cell region may be set to gradually change from the first super cell region toward the second super cell region, in an intermediate region in which the first super cell region and the second super cell region overlap each other. According to the dot recording apparatus of this aspect, gradation having a ratio in charge of dot recording is formed in the intermediate region in which the first and second super cell regions overlap each other, and thus it is possible to make banding or a joint stripe less likely to be conspicuous.

(6) In the dot recording apparatus of the aspect, when a boundary line of any of the individual super cell regions includes portions which are parallel to the main scanning direction, the parallel boundary line portions may be recorded by the same pass. According to the dot recording apparatus of this aspect, dots are formed in the same pass on the upper and lower sides of the boundary line. Accordingly, even when a boundary is parallel to the main scanning direction, banding and a joint stripe cannot be generated.

(7) In the dot recording apparatus of the aspect, a value of the N may be 4. According to the dot recording apparatus of this aspect, even when the super cell region has any shape, it is possible to place a predetermined region by four passes.

(8) In the dot recording apparatus of the aspect, the super cell regions may have similar shapes. According to the dot recording apparatus of this aspect, since the super cell regions have similar shapes, it is possible to reduce the size of a memory for specifying the super cell regions.

Meanwhile, the invention can be implemented in various forms. For example, the invention can be implemented in various forms such as a dot recording method, a computer program for creating raster data for executing dot recording, a recording medium storing a computer program for creating raster data for executing dot recording, a method of manufacturing a recording medium, and a recording medium having dots recorded thereon, in addition to a dot recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
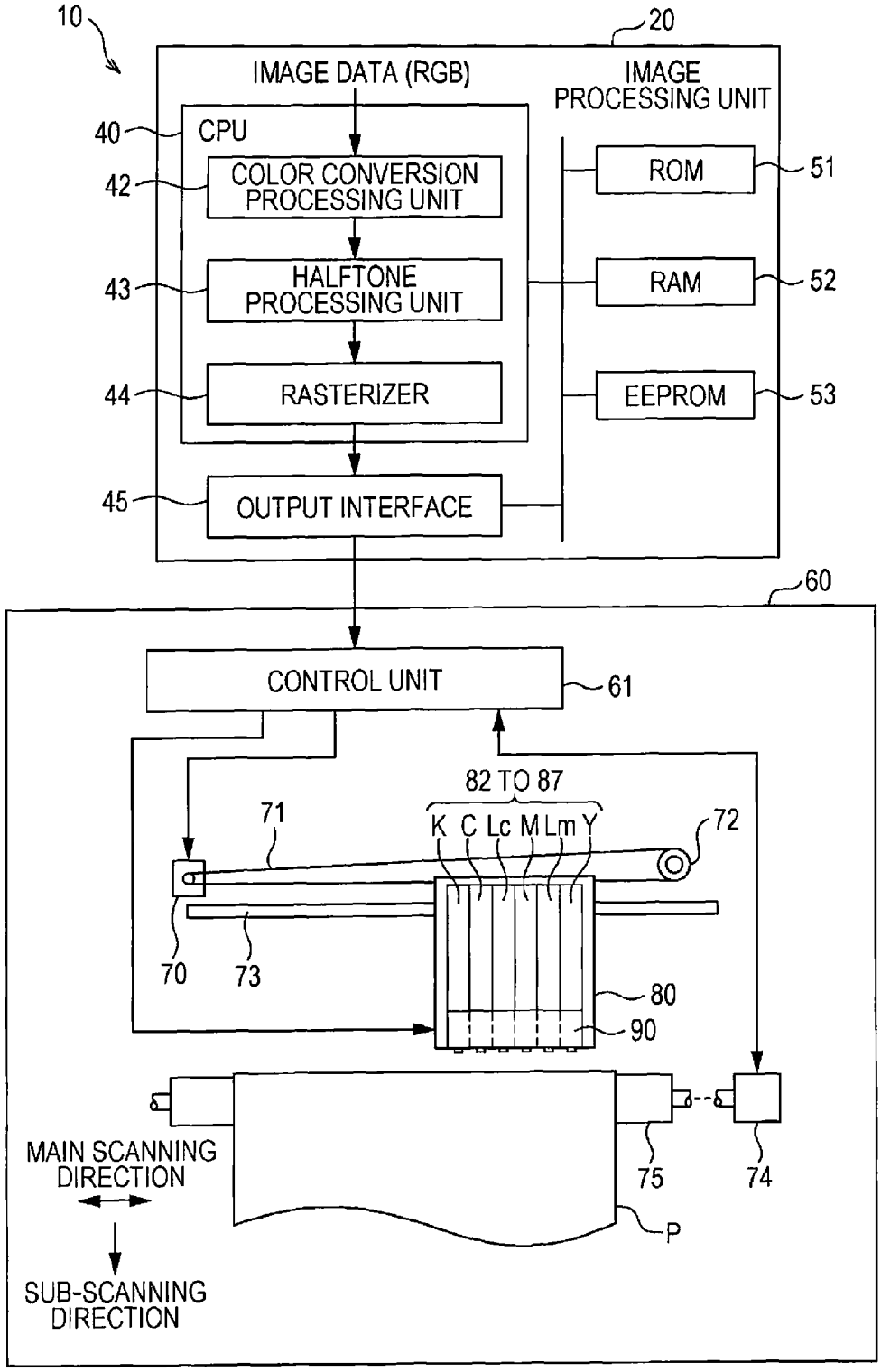
FIG. 1 is a diagram illustrating the configuration of a dot recording system.

FIG. 1 is a diagram illustrating the configuration of a dot recording system. A dot recording system 10 includes an image processing unit 20 and a dot recording unit 60. The image processing unit 20 generates printing data for the dot recording unit 60 from image data (for example, image data of RGB).

The image processing unit includes a CPU 40 (also referred to as "control unit 40"), a ROM 51, a RAM 52, an EEPROM 53, and an output interface 45. The CPU 40 has functions of a color conversion processing unit 42, a halftone processing unit 43, and a rasterizer 44. The functions are realized by a computer program. The color conversion processing unit 42 converts multi-gradation RGB data of an image into ink amount data indicating the amount of a plurality of colors of ink. The halftone processing unit 43 performs halftone processing on ink amount data to thereby create dot data indicating dot formation conditions for each pixel. The rasterizer 44 rearranges dot data generated by halftone processing to dot data used in individual main scanning performed by the dot recording unit 60. Hereinafter, dot data for each main scanning which is generated by the rasterizer 44 will be referred to as "raster data". Dot recording operations to be described in the following various embodiments are rasterizing operations (that is, operations expressed by raster data) which are realized by the rasterizer 44.

The dot recording unit 60, which is, for example, a serial type ink jet recording apparatus, includes a control unit 61, a carriage motor 70, a driving belt 71, a pulley 72, a sliding shaft 73, a sheet feed motor 74, a sheet feed roller 75, a carriage 80, ink cartridges 82 to 87, and a recording head 90.

The driving belt 71 is provided between the carriage motor 70 and the pulley 72. The carriage 80 is attached to the driving belt 71. The ink cartridges 82 to 87 respectively accommodating, for example, cyan ink (C), magenta ink (M), yellow ink (Y), black ink (K), light cyan ink (Lc), and light magenta ink (Lm) are mounted on the carriage 80. Meanwhile, various ink other than these examples can be used as ink. A nozzle array corresponding to ink of the above-mentioned colors is formed in the recording head 90 located on the lower side of the carriage 80. When the ink cartridges 82 to 87 are installed in the carriage 80 from above, ink can be supplied to the recording head 90 from each of the cartridges. The sliding shaft 73 is disposed in parallel with the driving belt and penetrates the carriage 80.

When the carriage motor 70 drives the driving belt 71, the carriage 80 moves along the sliding shaft 73. This direction is referred to as a "main scanning direction". The carriage motor 70, the driving belt 71, and the sliding shaft 73 constitute a main scanning driving mechanism. The ink cartridges 82 to 87 and the recording head 90 also move in the main scanning direction in association with the movement of the carriage 80 in the main scanning direction. During the movement in the main scanning direction, ink is ejected onto a recording medium P (typically, a printing sheet) from a nozzle (to be described later) which is disposed at the recording head 90, and thus dot recording on the recording medium P is performed. In this manner, the movement of the recording head 90 in the main scanning direction and the ejection of ink are referred to as main scanning, and one main scanning is referred to as "main scanning pass" or is simply referred to as "pass".

The sheet feed roller 75 is connected to the sheet feed motor 74. During recording, the recording medium P is inserted on the sheet feed roller 75. When the carriage 80 moves up to an end portion in the main scanning direction, the control unit 61 rotates the sheet feed motor 74. Thereby, the sheet feed roller 75 also rotates to thereby move the recording medium P. A direction of a relative movement between the recording medium P and the recording head 90 is referred to as a "sub-scanning direction". The sheet feed motor 74 and the sheet feed roller 75 constitute a sub-scanning driving mechanism. The sub-scanning direction is a direction perpendicular (orthogonal) to the main scanning direction. However, the sub-scanning direction and the main scanning direction do not necessarily need to be perpendicular to each other, and may intersect each other. Meanwhile, in general, a main scanning operation and a sub-scanning operation are alternately performed. In addition, as a dot recording operation, at least one of a unidirectional recording operation of performing dot recording through main scanning on a forward path and a bidirectional recording operation of performing dot recording through main scanning on both a forward path and a backward path can be performed. A direction of the main scanning on the forward path is merely opposite to a direction of the main scanning for the backward path, and thus a description will be given below without discriminating between a forward path and a backward path as long as it is not particularly required.

The image processing unit 20 may be formed integrally with the dot recording unit 60. In addition, the image processing unit 20 may be stored in a computer (not shown) and may be formed separately from the dot recording unit 60. In this case, the image processing unit 20 may be executed by a CPU as printer driver software (computer program) on a computer.

Figure 2:
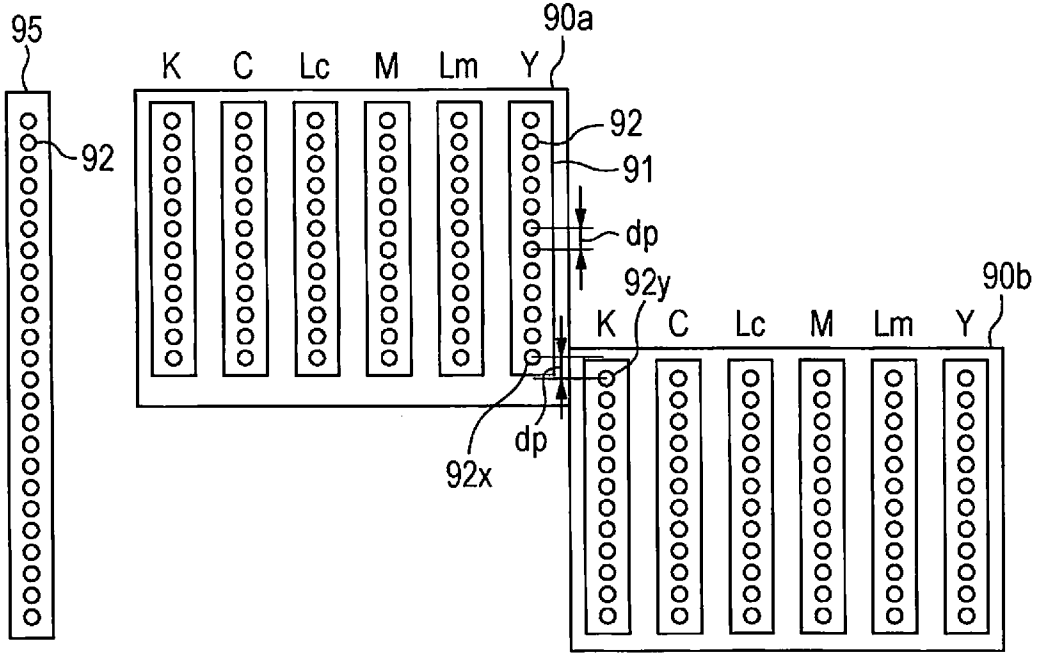
FIG. 2 is a diagram illustrating an example of the configuration of a nozzle array of a recording head.

FIG. 2 is a diagram illustrating an example of the configuration of a nozzle array of the recording head 90. Meanwhile, in FIG. 2, an illustration is given on the assumption that the number of recording heads 90 is two. However, the number of recording heads 90 may be one or may be two or more. Each of two recording heads 90*a* and 90*b* includes a nozzle array 91 for each color. Each nozzle array 91 includes a plurality of nozzles 92 which are lined up in a sub-scanning direction at a fixed nozzle pitch dp. A nozzle 92*x* at an end portion of the nozzle array 91 of the first recording head 90*a* and a nozzle 92*y* at an end portion of the nozzle array 91 of the second recording head 90*b* are shifted in the sub-scanning direction by the same size as the nozzle pitch dp in the nozzle array 91. In this case, nozzle arrays of the two recording heads 90*a* and 90*b* for one color are equivalent to a nozzle array 95 (illustrated on the left side of FIG. 2) having the number of nozzles which is twice the number of nozzles of one recording head 90 for one color. In the following description, a method of performing dot recording for one color using the equivalent nozzle array 95 will be described. Meanwhile, in the first embodiment, the nozzle pitch dp is equivalent to a pixel pitch on a printing medium P. However, the nozzle pitch dp can also be set to an integral multiple of the pixel pitch on the printing medium P. In the latter case, so-called interlace recording (an operation of recording dots by a second pass and the subsequent passes so as to fill a gap between dots between main scanning lines recorded by a first pass) is performed. The nozzle pitch dp is a value equivalent to, for example, 720 dpi (0.035 mm).

Figure 3:
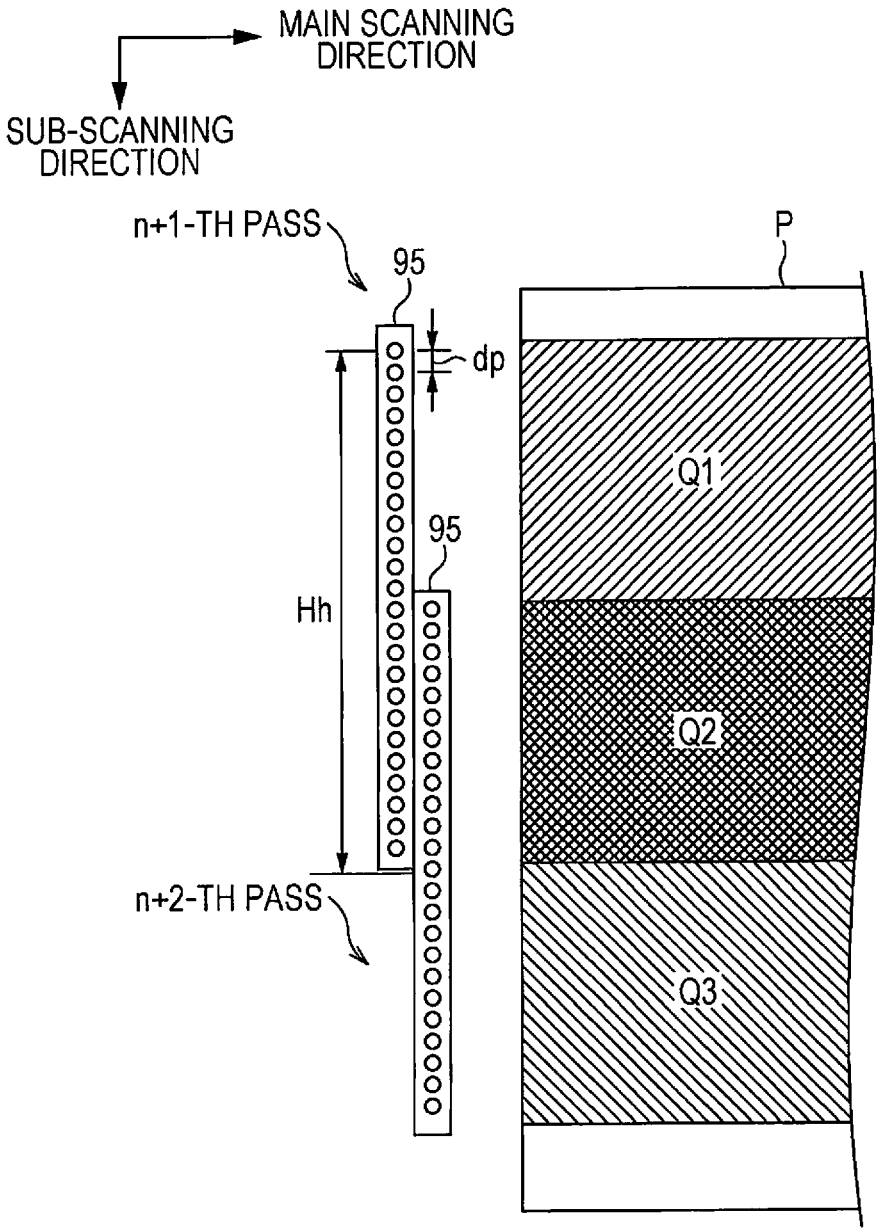
FIG. 3 is a diagram illustrating positions of nozzle arrays in two main scanning passes of dot recording and recording regions at the positions in a first embodiment.

FIG. 3 is a diagram illustrating the position of the nozzle array 95 in two main scanning passes of dot recording in the first embodiment, and a recording region at the position. In the following description, a case where dots are formed in all pixels of a recording medium P using ink of one color (for example, cyan ink) will be described as an example. In this specification, a dot recording operation of completing the formation of dots on individual main scanning lines by N main scanning passes (N is an integer of 2 or greater) will be referred to as "multi-pass recording". In the present embodiment, the number of passes N of multi-pass recording is 2. In a first (n+1-th pass (n is an integer of 0 or greater)) pass (1P) and a second (n+2-th pass) pass (2P), the position of the nozzle array 95 is shifted in the sub-scanning direction by a distance equivalent to half of a head height Hh. Here, "head height Hh" means a distance indicated by M×dp (M is the number of nozzles of the nozzle array 95, dp is a nozzle pitch).

In the n+1-th pass, dot recording is performed in some of all pixels of a region Q1 constituted by a main scanning line through which nozzles located at an upper half portion of the nozzle array 95 pass and some of all pixels of a region Q2 constituted by a main scanning line through which nozzles located at a lower half portion of the nozzle array 95 pass in the recording medium P. In the n+2-th pass, dot recording is performed in the remaining pixels in which no dot is formed in the n+1-th pass in all of the pixels of the region Q2 constituted by the main scanning line through which the nozzles located at the upper half portion of the nozzle array 95 pass and some of all pixels of a region Q3 constituted by a main scanning line through which the nozzles located at the lower half portion of the nozzle array 95 pass in the recording medium P. Accordingly, in the region Q2, the recording of 100% of the pixels is performed collectively in the n+1-th and n+2-th passes. Meanwhile, in an n+3-th pass, dots are formed in the remaining pixels of the region Q3 and some pixels of the next region Q4 (not shown). Here, a case where an image (solid image) having dots being formed in all of the pixels of the recording medium P is formed on the recording medium P is assumed. However, a real recording image (printing image) indicated by dot data includes pixels in which dots are actually formed on the recording medium P and pixels in which dots are not actually formed on the recording medium P. That is, whether or not to actually form dots in pixels of the recording medium P is determined by dot data generated by halftone processing. In this specification, the phrase "dot recording" used herein means "execution of the formation or non-formation of dots". In addition, the phrase "execution of dot recording" is not related to whether or not to actually form dots on the recording medium P, and is used as a phrase that means "taking charge of dot recording".

Figure 4:
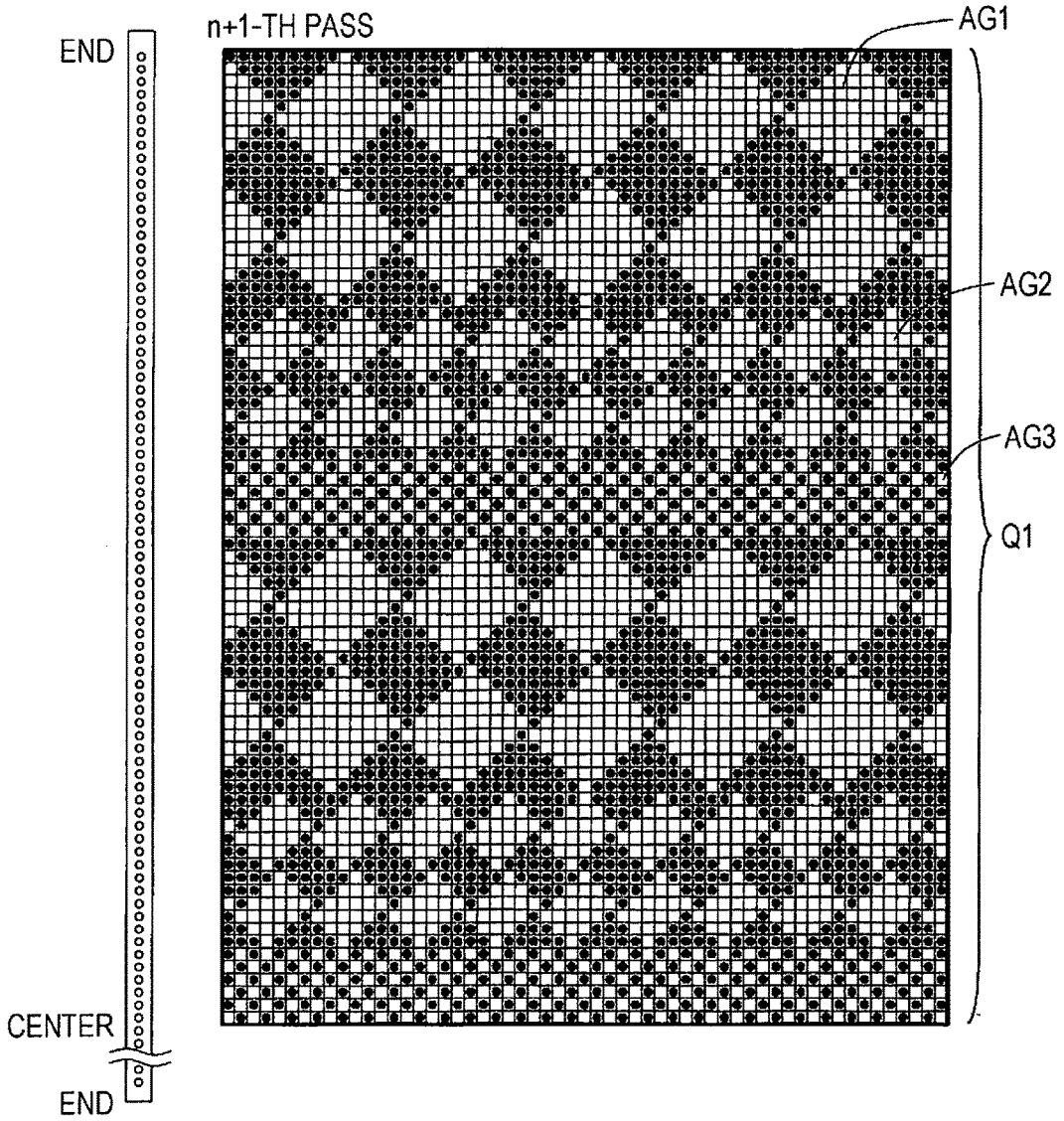
FIG. 4 is a diagram illustrating a dot recording state of a region Q1 in an n+1-th pass (n is an integer of 0 or greater).

FIG. 4 is a diagram illustrating a dot recording state of the region Q1 (FIG. 3) in the n+1-th pass (n is an integer of 0 or greater). In the drawing, each small quadrangle is a region of one pixel, and a dot indicated by a black circle is a dot which is recorded in an n+1-th pass. A square in which a dot of a black circle is not recorded is a pixel which is recorded in an n-th pass (previous pass). However, when a dot of the n-th pass is written, the dot is not likely to be observed, and thus the dot of the n-th pass is not illustrated in FIG. 4. An upper portion of FIG. 4 is a rear end portion side (upper end portion side of FIG. 3) of the nozzle array 95, and a lower portion of FIG. 4 is a center portion side of the nozzle array 95. Dots formed in squares (dots recorded in an n-th pass, squares that are not marked with black circles), except for dots in the n+1-th pass of FIG. 4, form three types of masses. Masses AG1 of large-sized quadrilateral dots are lined up in two rows from the rear end portion side of the nozzle array 95, masses AG2 of medium-sized quadrilateral dots are lined up in two rows, and masses AG3 of one dot are lined up in six rows. Meanwhile, the phrase "masses of large-sized quadrilateral dots" means that masses of dots form a quadrangle and that the size of the quadrangle is relatively large. Meanwhile, the phrase "mass of dots" means that the number of dots included in the mass is two or more. However, in the present embodiment, a case of being one dot is called a "mass". In addition, in FIGS. 4 and 5, for convenience of illustration, the smallest number of dots of a mass is assumed to be one, but a mass having the smallest number of dots may include a plurality of dots, as described later. In the present embodiment, the above-mentioned eight rows (38 pixels in the sub-scanning direction) are set to be one set, and two sets form dots of an n-th pass in the region Q1. Dots recordable in the n+1-th pass in the region Q1 are dots excluding dots of three types of masses which are marked in the n-th pass.

Figure 5:
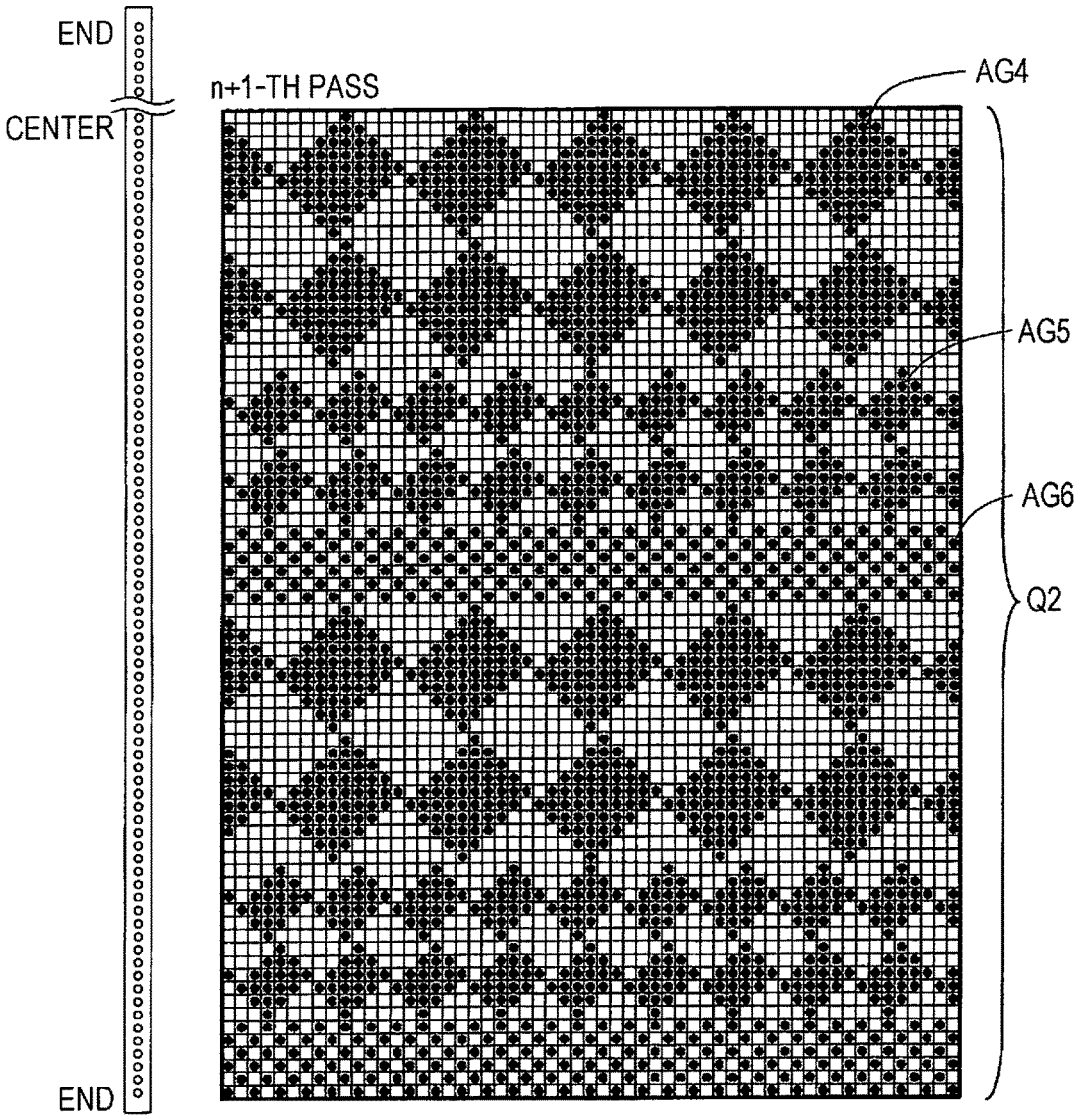
FIG. 5 is a diagram illustrating a dot recording state of a region Q2 in an n+1-th pass.

FIG. 5 is a diagram illustrating a dot recording state of the region Q2 (FIG. 3) in the n+1-th pass. Similarly to FIG. 4, a dot indicated by a black circle is a dot which is recorded in the n+1-th pass. A square in which a dot of a black circle is not recorded is a region which is recorded in the next n+2-th pass. However, in FIG. 5, the dot of the n+2-th pass is not likely to be observed, and thus is not illustrated in the drawing. An upper portion of FIG. 5 is a center portion side of the nozzle array 95, and a lower portion of FIG. 5 is a front end portion side (lower end side of FIG. 3) of the nozzle array 95. In FIG. 5, on the contrary to FIG. 4, dots of the n+1-th pass form three types of masses. That is, masses AG4 of large-sized quadrilateral dots are lined up in two rows from the center portion side of the nozzle array 95, masses AG5 of medium-sized quadrilateral dots are lined up in two rows, and masses AG6 of one dot are lined up in six rows. Meanwhile, the eight rows (38 pixels) are set to be one set, and two sets form dots of the n+1-th pass in the region Q2. Dots recordable in the n+2-th pass in the region Q2 are dots excluding marked dots in the n+1-th pass. As seen from FIGS. 4 and 5, in forming dots in a predetermined region (for example, the regions Q1 and Q2, and the like), dots are formed as three types of masses in the first pass, and dots in the remaining regions are formed in the next pass, and thus the recording of dots in the regions is completed by two passes.

Figure 6:
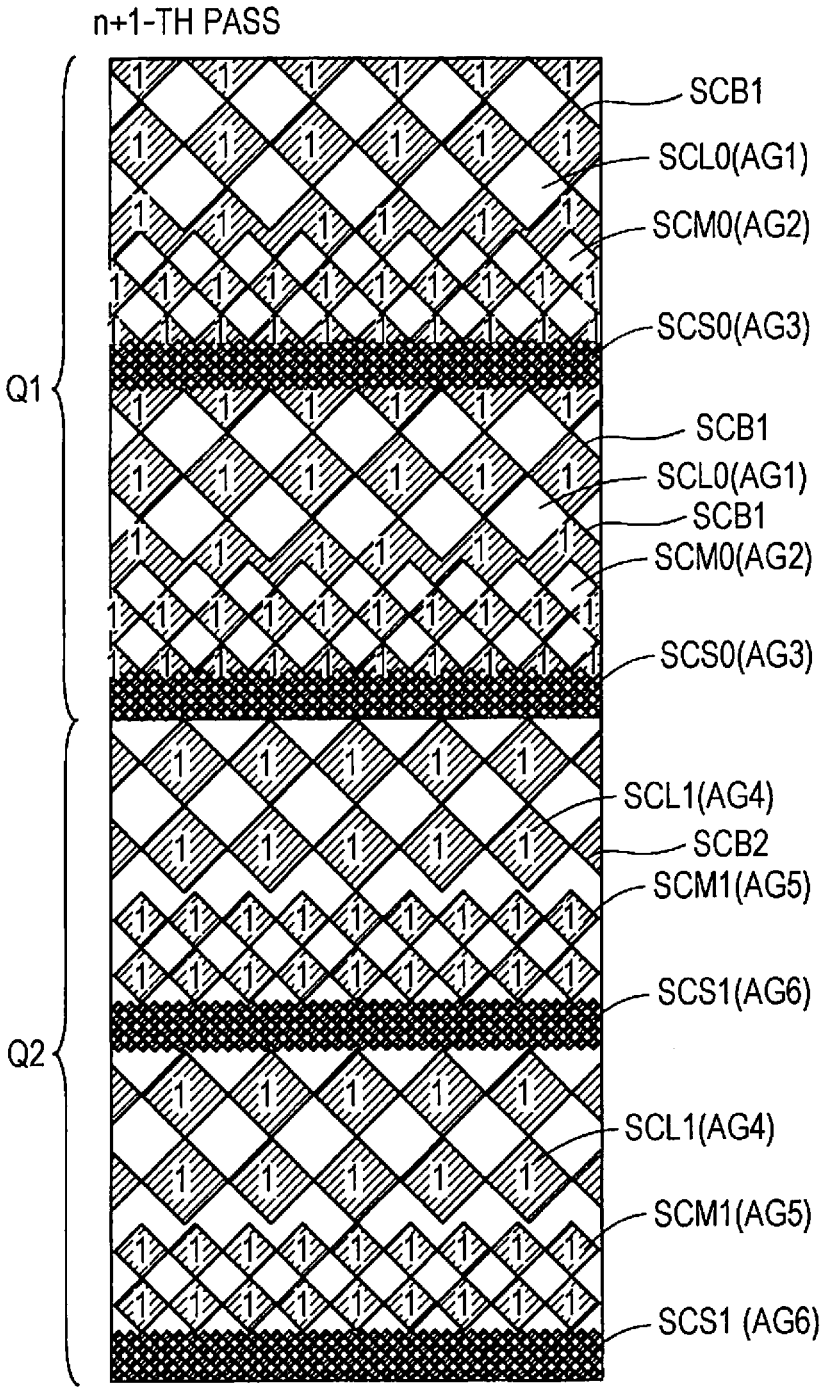
FIG. 6 is a diagram illustrating regions that are recorded in an n+1-th pass in regions Q1 and Q2.

FIG. 6 is a diagram illustrating a region which is recorded in an n+1-th pass in regions Q1 and Q2, and is a schematic, diagram illustrating the entire region including both FIG. 4 and FIG. 5. Meanwhile, this drawing is the same as a mask which is used for dot recording of the n+1-th pass. Meanwhile, the term "mask" used herein is pixel data separately indicating a pixel which is a target for dot recording in the pass and a pixel which is not a target for dot recording. In FIG. 6, the number "1" is written in regions that are recorded in the n+1-th pass.

Focusing on the region Q2, in the region Q2, large-sized quadrilateral masses are lined up in two rows, medium-sized quadrilateral masses are lined up in two rows, and small-sized quadrilateral masses are lined up in six rows from a boundary between the region Q2 and the region Q1. These masses are referred to as super cell regions SCL1(AG4), SCM1(AG5), and SCS1(AG6) in descending order of the size. The super cell region refers to a region which is formed as one mass (dot group) by some nozzles 92 of the nozzle array 95. In the region Q2, regions SCB2 that are not hatched are regions excluding the super cell regions SCL1 (AG4), SCM1(AG5), and SCS1(AG6), and dots are recorded therein in an n+2-th pass. Similarly, regions that are not hatched in the region Q1 are partitioned with super cell regions SCL0(AG1), SCM0(AG2), and SCS0(AG3) as units, and dots are recorded therein in an n-th pass. Meanwhile, the regions SCB2 of the region Q2 excluding the super cell regions SCL1(AG4), SCM1(AG5), and SCS1 (AG6) have the same shapes as those of the super cell regions SCL1(AG4), SCM1(AG5), and SCS1(AG6) except for the vicinity of a boundary between the super cell regions SCL1(AG4) and SCM1(AG5) and the vicinity of a boundary between the super cell regions SCM1(AG5) and SCS1 (AG6), and thus are referred to as super cell regions SCB2.

Figure 7:
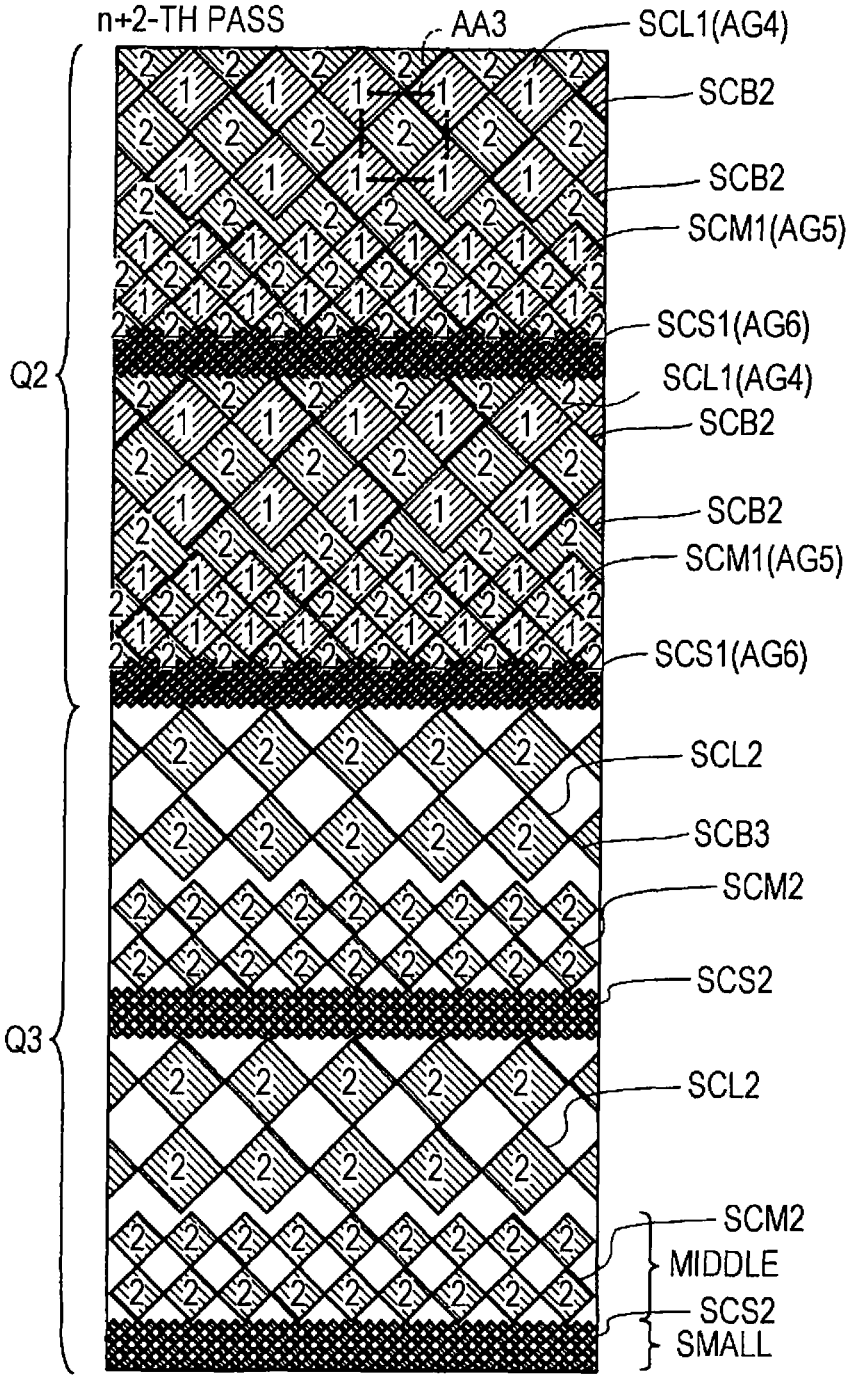
FIG. 7 is a diagram illustrating regions that are recorded in an n+1-th pass and an n+2-th pass in regions Q2 and Q3.

FIG. 7 is a diagram illustrating regions that are recorded in an n+1-th pass and an n+2-th pass in the regions Q2 and Q3 of FIG. 3. Similar to FIG. 6, in regions that are recorded in the n+1-th pass, super cell regions SCL1(AG4), SCM1 (AG5), and SCS1(AG6) are hatched, and the number "1" is written in the super cell regions SCL1(AG4) and SCM1 (AG5). For convenience of illustration, the number "1" is omitted in the super cell region SCS1(AG6). In FIG. 7, super cell regions SCL2, SCM2, SCS2, and SCB2 that are recorded in the n+2-th pass, and the number "2" is written in the super cell regions SCL2, SCM2, and SCS2. Also in FIG. 7, the super cell regions SCL2, SCM2, SCS2, and SCB2 are lined up in the same pattern as in FIG. 6. Meanwhile, regions that are not hatched in the region Q3 are super cell regions SCB3 that are recorded in an n+3-th pass.

Figure 8A:
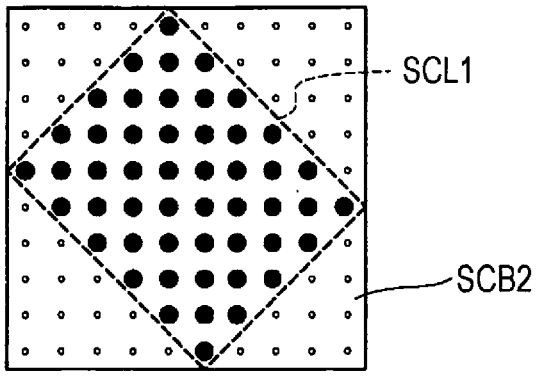
FIGS. 8A to 8D are diagrams illustrating a relationship between a dot pattern and a super cell region.
Figure 8B:
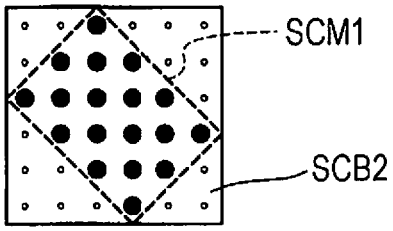
Figure 8C:
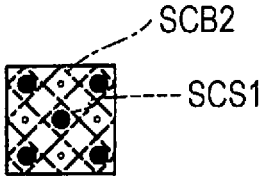
Figure 8D:
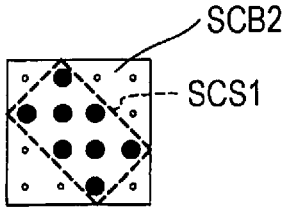

FIGS. 8A to 8D are diagrams illustrating a relationship between a dot pattern and a super cell region. FIGS. 8A, 8B, and 8C illustrate super cell regions SCL1, SCM1, and SCS1, respectively. A black circle indicates a pixel which is a target for dot recording in an n+1-th pass, and a dot is recorded in a small white circle in an n+2-th pass without being recorded in a small white circle in an n+1-th pass. The region recorded in the n+2-th pass is the above-mentioned super cell region SCB2. Since one dot is recorded in the super cell region SCS1, the super cell region cannot be used for comparison. However, as seen from the comparison between the super cell regions SCL1 and SCM1, the super cell regions SCL1 and SCM1 are substantially similar to each other. Therefore, when the size, arrangement coordinates, and a lateral direction of a super cell region are determined at the time of forming a mask pattern including a plurality of types of super cell regions, it is possible to easily form the super cell region and the mask pattern. Accordingly, it is possible to reduce the amount of memory used for forming the mask pattern. Meanwhile, as illustrated in FIG. 8D, the number of dots formed in the super cell region SCS1 may be greater than one and may be two or more which is smaller than the number of dots in the super cell region SCM1. Meanwhile, in FIGS. 8A to 8D, the number of dots is merely an example. The number of dots is not limited to those illustrated in FIGS. 4 and 5 and FIGS. 8A to 8D as long as it satisfies the relation of SCL1>SCM1>SCS1.

In the present embodiment, regarding a predetermined region, in order to distinguish between regions recorded in the n+1-th pass and regions recorded in the n+2-th pass, the super cell regions SCL1, SCM1, and SCS1 that are recorded in the n+1-th pass are referred to as "first super cell regions", and the super cell regions SCB2 recorded in the n+2-th pass are referred to as "second super cell regions". The first super cell region and the second super cell region come into contact with each other at mutual boundary lines, and do not have portions that mutually overlap each other. In addition, the boundary lines between the first super cell region and the second super cell region are not parallel to each other in either the main scanning direction or the sub-scanning direction. Thereby, banding or a joint stripe which is parallel to the main scanning direction and banding or a joint stripe which is parallel to the sub-scanning direction are not likely to be generated, and thus it is possible to make banding or a joint stripe less likely to be conspicuous in the entire image. Meanwhile, the phrase "super cell region" used herein means a region constituted by a large number of pixels and a region including a plurality of unit cells.

Meanwhile, it is preferable that the boundary lines of the first super cell region and the second super cell region are constituted by a boundary line portion which is parallel to a straight line connecting the center points of pixels (outermost peripheral pixels) present at the outermost periphery of the first super cell region and which is drawn between the outermost peripheral pixels and other pixels that are present on the outer side thereof. The same is true of the second super cell region. On the other hand, in many cases, boundary lines between pixels are usually recognized as being formed in a lattice shape. When such boundary lines between pixels are used as boundary lines between the first super cell region and the second super cell region as they are, the shapes of the boundary lines are complicated, and thus the shapes of the first super cell region and the second super cell region are not likely to be recognized. Therefore, it is preferable that the above-mentioned definition is used as the boundary lines between the first super cell region and the second super cell region.

As described above, according to the first embodiment, in each main scanning pass, dot recording is performed with super cell regions, which have a plurality of types of sizes and have boundary line portions which are not parallel to either the main scanning direction or the sub-scanning direction, as units. Accordingly, it is possible to make banding or a joint stripe less likely to be conspicuous, as compared to a case where a boundary line between two super cell regions is constituted by only a boundary line parallel to the main scanning direction and a boundary line parallel to the sub-scanning direction. In addition, the super cell regions have a plurality of types of sizes, and thus it is possible to make the presence of the super cell regions less likely to be conspicuous.

Second Embodiment

Figure 9:
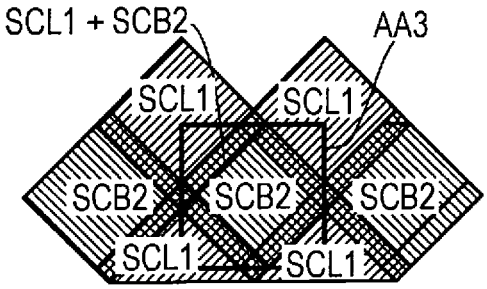
FIG. 9 is a diagram illustrating a second embodiment.

FIG. 9 is a diagram illustrating a second embodiment. FIG. 9 illustrates the super cell regions SCB2 and SCL1 in the region AA3 of FIG. 7. In the first embodiment, the super cell regions SCB2 and SCL1 do not overlap each other. On the other hand, the second embodiment is different from the first embodiment in that the super cell regions SCB2 and SCL1 partially overlap each other.

Figure 10:
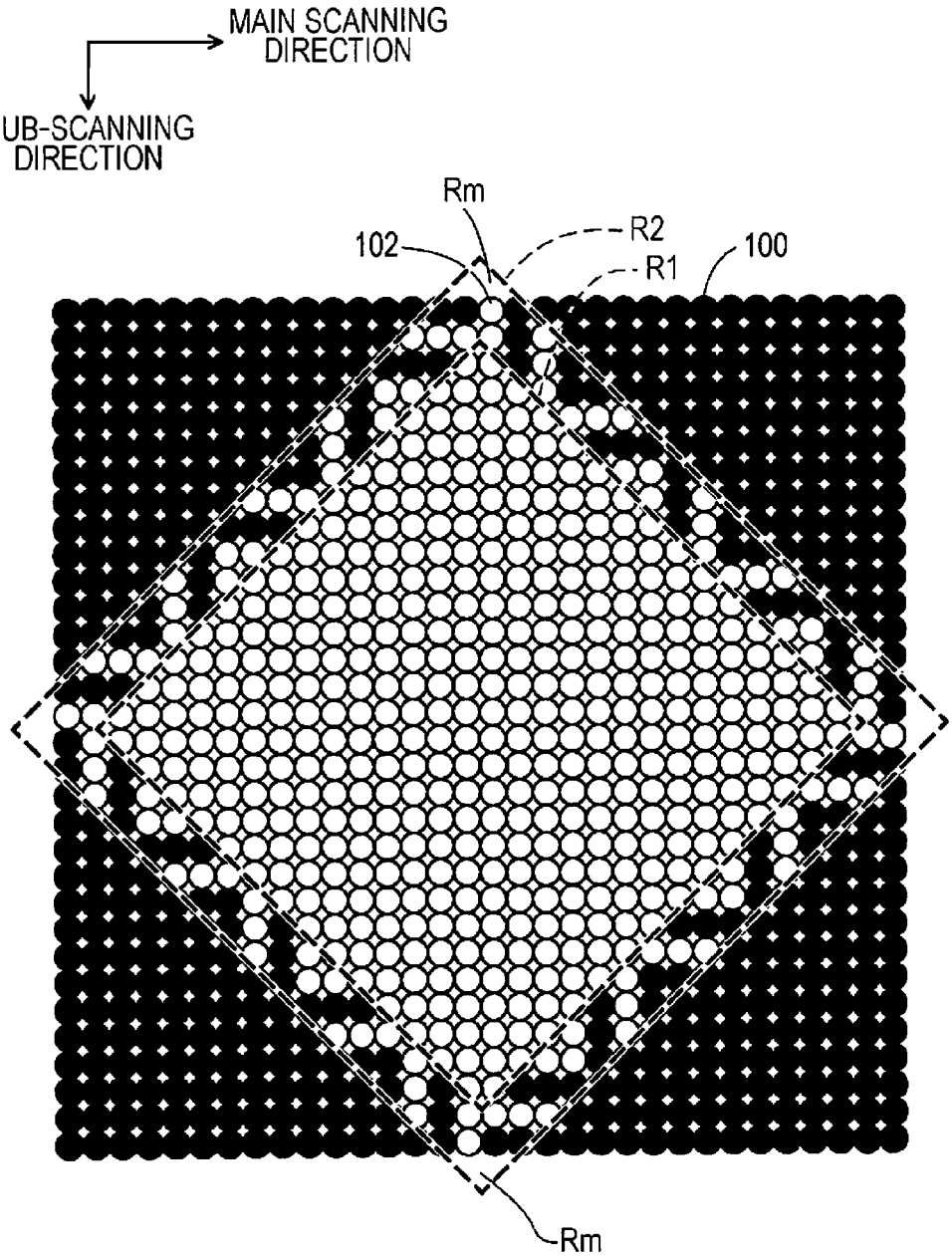
FIG. 10 is an enlarged view of a dot pattern in a region AA3 of FIG. 9.

FIG. 10 is an enlarged view of a dot pattern in a region AA3 of FIG. 9. Here, in order to simplify a rate of gradation (to be described later) in a boundary between the unit super cells SCL1 and SCB2, region AA3 is shown by 32 dots×32 dots. A black circle 100 indicates a pixel position (pixel position at which dot recording is performed in an n+1-th pass) which is included in a first super cell region SCL1, and a white circle 102 indicates a pixel position (pixel position at which dot recording is performed in an n+2-th pass) which is included in a second super cell region SCB2. In FIG. 10, a first dashed line R1 indicates a boundary line (contour line) of the first super cell region SCL1. That is, the pixel position at which dot recording is performed in the n+1-th pass is included in the boundary line R1. In the same meaning, a second dashed line R2 also indicates a boundary line (contour line) of the second super cell region SCB2. An intermediate region Rm between the dashed line R1 and the dashed line R2 is a region in which the first super cell region SCL1 and the second super cell region SCB2 overlap each other and the black circles 100 and the white circles 102 are mixed. Meanwhile, as can be understood from the above description, in the second embodiment, the boundary line R1 of the first super cell region SCL1 and the boundary line R2 of the second super cell region SCB2 are located at different positions. In the present embodiment, in the intermediate region Rm (region in which two super cell regions SCL1 and SCB2 partially overlap each other) in which the black circles 100 and the white circles 102 are mixed, dot recording is completed by two passes. It is possible to make banding less likely to be conspicuous by providing such an intermediate region Rm.

In the present embodiment, the inside of the intermediate region Rm is further divided into a plurality of (specifically, three) layered regions. That is, in the layered region immediately inside the dashed line R2, a ratio of the black circles 100 to the white circles 102 is 2:1. In the intermediate layered region between the dashed line R1 and the dashed line R2, a ratio of the black circles 100 to the white circles 102 is 1:1. In the layered region immediately outside the dashed line R1, a ratio of the black circles 100 to the white circles 102 is 1:2. In this manner, in the intermediate region Rm in which two super cell regions SCL1 and SCB2 overlap each other, a ratio of the black circles 100 to the white circles 102 may be configured to change in a stepwise manner. Thereby, it is possible to make banding less likely to be conspicuous. In this manner, in the intermediate region Rm, a configuration in which a ratio of the number of pixel positions at which dot recording is performed in an odd-numbered pass to the number of pixel positions at which dot recording is performed in an even-numbered pass gradually changes from one super cell region toward the other super cell region is also referred to as "gradation having a ratio in charge of dot recording". Here, the phrase "ratio in charge of dot recording" used herein means a ratio of the number of pixel positions at which dot recording is performed in an odd-numbered pass to the number of pixel positions at which dot recording is performed in an even-numbered pass.

It is preferable that the intermediate region Rm between the two super cell regions SCL1 and SCB2 dot not include either a set of black circles 100 of p×p pixels (p is an integer of 2 or greater) or a set of white circles 102 of p×p pixels. Here, 2, 3, 4, 5, or the like is preferably used as the value of p. In this manner, the defining of the intermediate region Rm makes the range of the intermediate region Rm clearer. From the same meaning, it is preferable that the boundary line of the first super cell region SCL1 is defined so that the first super cell region does not include a set of white circles 102 of p×p pixels (p is an integer of 2 or greater), and that the boundary line of the second super cell region SCB2 is defined so that the second super cell region does not include a set of black circles 100 of p×p pixels.

As described above, according to the second embodiment, since the boundaries of the first super cell region SCL1 and the second super cell region SCB2 overlap each other, it is possible to make banding or a joint stripe less likely to be conspicuous. Further, in the intermediate region Rm between the boundaries of the first super cell region SCL1 and the second super cell region SCB2, a stepwise change in a ratio of the black circles 100 to the white circles 102 can make banding less likely to be conspicuous.

Third Embodiment

Figure 11A:
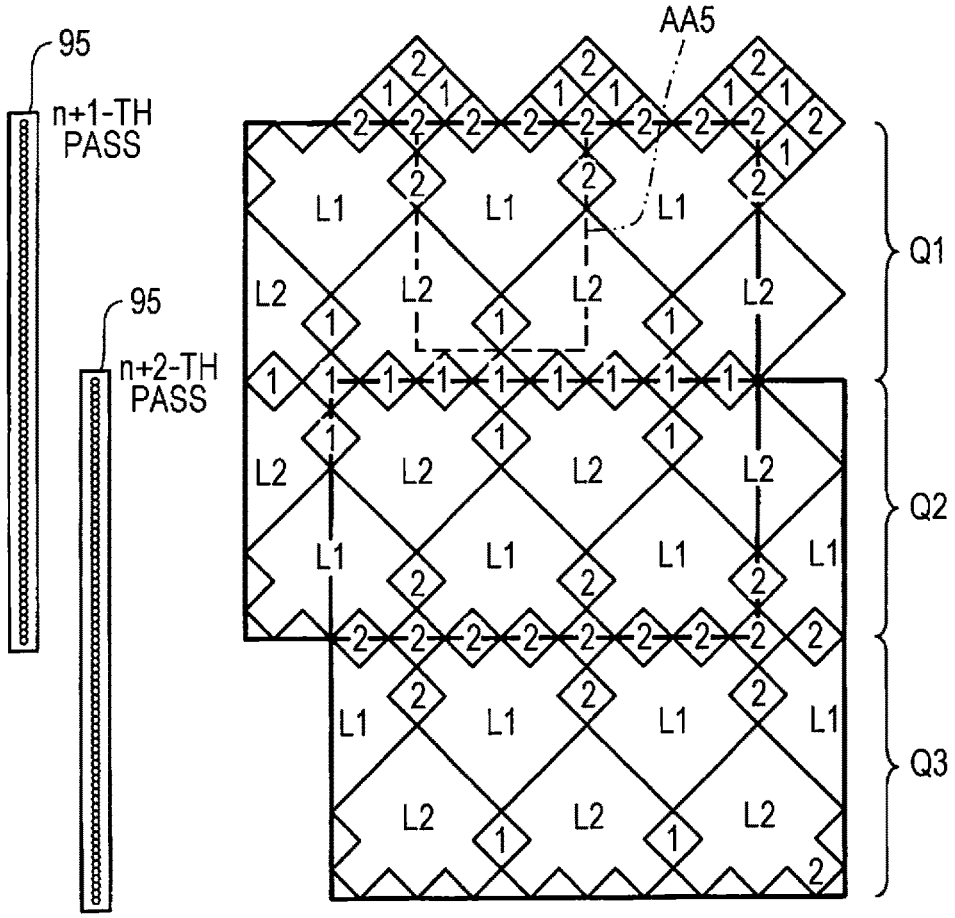
FIGS. 11A to 11C are diagrams illustrating a third embodiment.
Figure 11B:
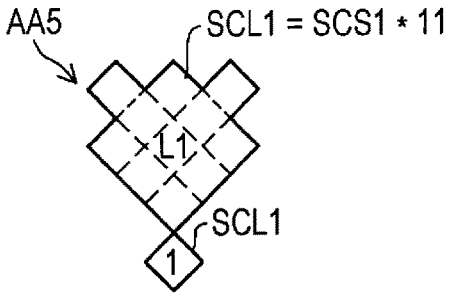
Figure 11C:
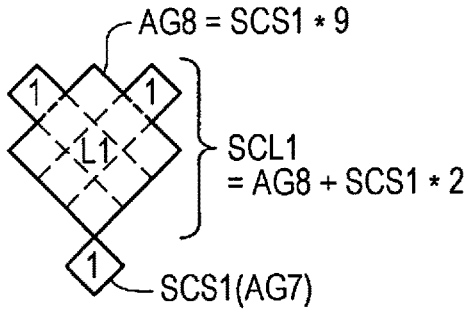

FIGS. 11A to 11C are diagrams illustrating a third embodiment. Similarly to the first embodiment, in the third embodiment, dot recording of a predetermined region is completed by two passes. Although there are three types of sizes of super cell regions in the first embodiment, there are two types (SCL1, SCS1) of sizes of super cell regions in the third embodiment. Meanwhile, the number of types of sizes of super cell regions is not limited as long as there are two or more types of sizes.

The positions of nozzle arrays 95 in respective passes (n+1 and n+2) are shown on the left side of FIG. 11A. Super cell regions recorded by the respective passes are written on the right side of FIG. 11A. The sign "L1" indicates a super cell region SCL1, the sign "1" indicates a super cell region SCS1, the sign "L2" indicates a super cell region SCL2, and the sign "2" indicates a super cell region SCS2. In the third embodiment, there are two types of super cell regions, and thus super cell regions SCM1, SCM2, SCB1, and SCB2 may not be present.

FIG. 11B is an enlarged view of AA5 of FIG. 11A. As seen from FIG. 11B, the size of the super cell region SCL1 is eleven times the size of the super cell region SCS1. In addition, as illustrated in FIG. 11C, the super cell region SCL1 may be considered to be a region formed by connecting two masses of dots, having similar shapes, to each other. A small mass AG7 of dots is the same as the super cell region SCS1. A large mass AG8 of dots is a collection of nine super cell regions SCS1 and has a similar shape to that of the super cell region SCS1. The super cell region SCL1 is formed by connecting the large mass AG8 of dots and two small masses AG7 of dots to each other. In this manner, when a plurality of masses of dots are formed to have similar shapes and two masses (the size does not matter) of dots are adjacent to each other, a configuration may also be adopted in which the masses are connected to each other to thereby form a large super cell region.

As described above, also in the third embodiment, in each main scanning pass, dot recording is performed with super cell regions, which have a plurality of types of sizes and have boundary line portions which are not parallel to either the main scanning direction or the sub-scanning direction, as units. Accordingly, it is possible to make banding or a joint stripe less likely to be conspicuous, compared to a case where a boundary line between two super cell regions is constituted by only a boundary line parallel to the main scanning direction and a boundary line parallel to the sub-scanning direction. In addition, the super cell regions have a plurality of types of sizes, and thus it is possible to make the presence of the super cell regions less likely to be conspicuous.

Fourth Embodiment

Figure 12:
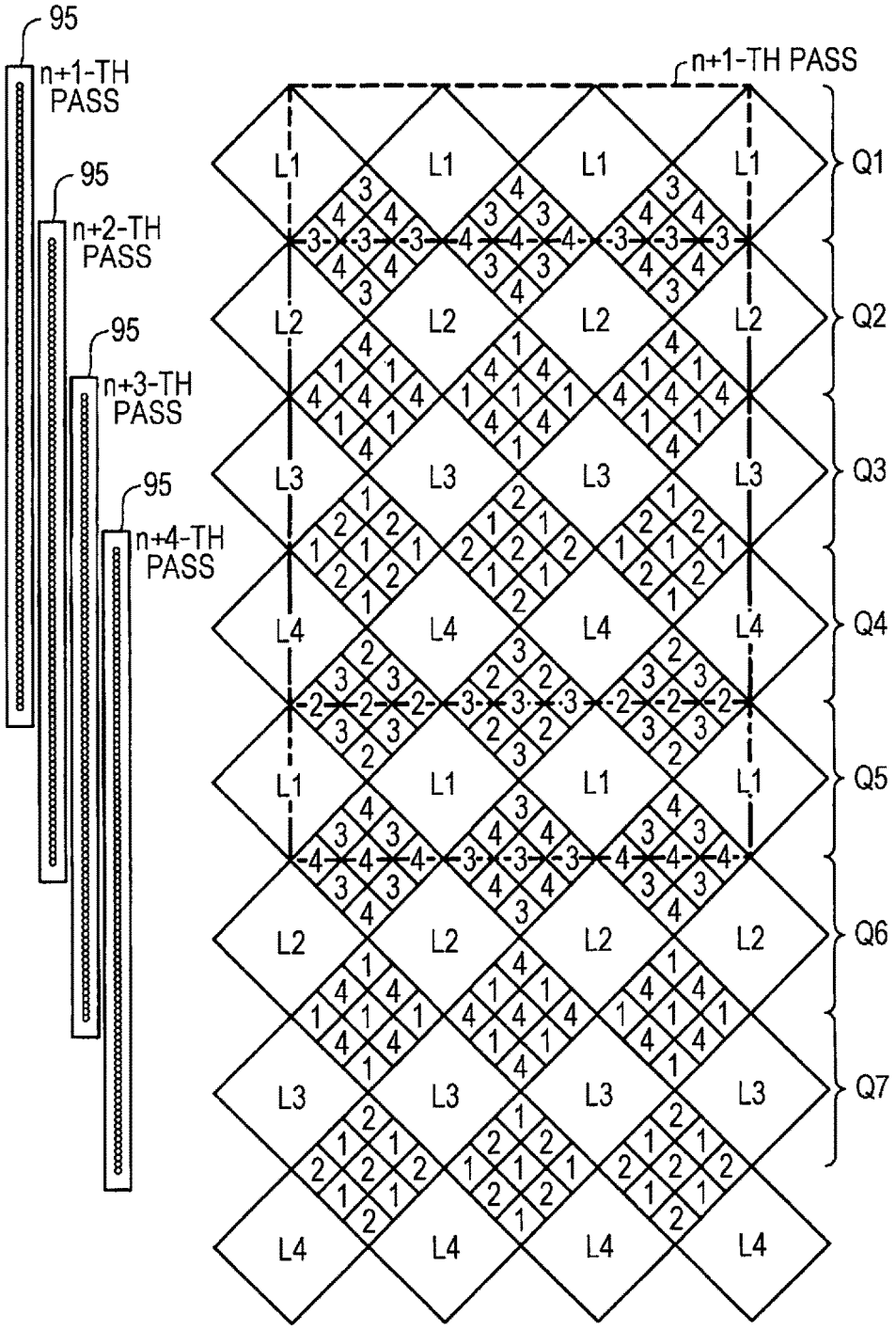
FIG. 12 is a diagram illustrating a fourth embodiment.

FIG. 12 is a diagram illustrating a fourth embodiment. In the fourth embodiment, the dot recording of a predetermined region is completed by four passes. The positions of nozzle arrays 95 in respective passes (n+1, n+2, n+3, and n+4) are shown on the left side of FIG. 12. Super cell regions recorded by the respective passes are written on the right side of FIG. 12. The sign "L1" indicates a super cell region SCL1, the sign "1" indicates a super cell region SCS1, the sign "L2" indicates a super cell region SCL2, the sign "2" indicates a super cell region SCS2, the sign "L3" indicates a super cell region SCL3, the sign "3" indicates a super cell region SCS3, the sign "L4" indicates a super cell region SCL4, and the sign "4" indicates a super cell region SCS4. The super cell regions SCL1, SCL2, SCL3, and SCL4 have the same shape, and the super cell regions SCS1, SCS2, SCS3, and SCS4 have the same shape. In addition, the super cell regions SCL1, SCL2, SCL3, and SCL4 and the super cell regions SCS1, SCS2, SCS3, and SCS4 are similar to each other. Since the super cell regions have a quadrilateral shape, a ratio of the size of each of the smallest super cell regions SCS1, SCS2, SCS3, and SCS4 to the size of each of the next small super cell regions SCL1, SCL2, SCL3, and SCL4 is 1:9. Here, 9 is calculated by $(4-1)^2$. When the super cell region has a triangular shape, a ratio of the size of each of the smallest super cell regions SCS1, SCS2, SCS3, and SCS4 to the size of each of the next small super cell regions SCL1, SCL2, SCL3, and SCL4 is 1:4. Here, 4 is calculated by $(3-1)^2$. In addition, as illustrated in the drawing, the super cell regions SCL1, SCL2, SCL3, and SCL4 and the super cell regions SCS1, SCS2, SCS3, and SCS4 have a circulative symmetry, and thus they are well balanced. Meanwhile, the super cell regions SCL1, SCL2, SCL3, and SCL4 and the super cell regions SCS1, SCS2, SCS3, and SCS4 may not necessarily have a circulative symmetry.

According to the fourth embodiment, the super cell region is equivalent to a mass of dots. A plurality of super cell regions can be disposed so as to have similar shapes without connecting a plurality of masses of dots as in the third embodiment. Accordingly, it is possible to reduce a memory at the time of creating a mask. That is, when only the arrangement of super cell regions in one pass (n+1-th pass) is specified, it is possible to create a mask by computation. When the mask is cyclically changed, it is possible to create a mask in another pass. In addition, even when the super cell region has any shape, it is possible to place a predetermined region through four passes by four color theorem.

Fifth Embodiment

Figure 13:
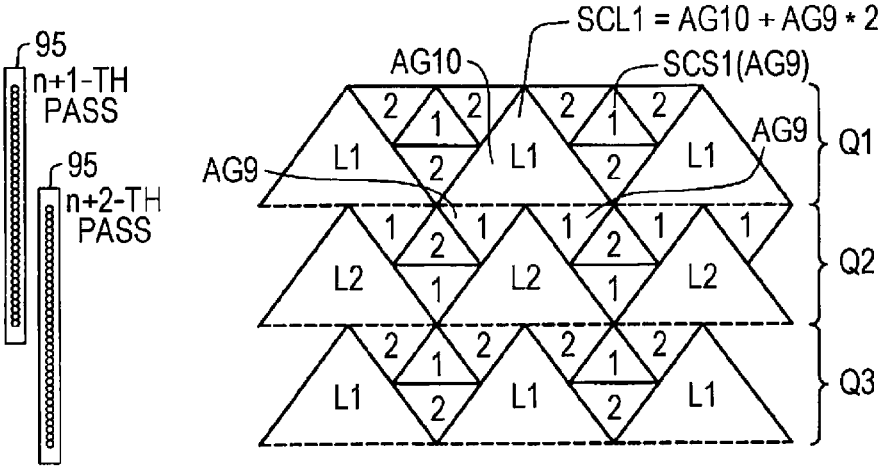
FIG. 13 is a diagram illustrating a fifth embodiment.

FIG. 13 is a diagram illustrating a fifth embodiment. In the fifth embodiment, dot recording of a predetermined region is completed by two passes. In the first to fourth embodiments, the super cell has a shape of a mass of quadrilateral dots or a shape in which masses of quadrilateral dots are connected to each other. However, the first to fourth embodiments is different from the fifth embodiment in that a super cell has a shape of a mass of triangular dots or has a shape in which masses of triangular dots are connected to each other. A small-sized super cell region has the same shape as that of a mass AG9 of small dots. A super cell region SCL1 has a shape in which two small triangular masses AG9 (having the same shape as that of a super cell region SCS1) of dots and a large triangular mass AG10 of dots are connected to each other, and has a size which is six times the size of the super cell region SCS1. A boundary between the super cell regions SCL1 and SCS2 and a boundary between the super cell regions SCS1 and SCL2 are not parallel to either a main scanning direction or a sub-scanning direction. A boundary between the super cell regions SCL1 and SCS1 and a boundary between the super cell regions SCL2 and SCS2 have a boundary line which is parallel to the main scanning direction. On the upper and lower sides of the boundary line, dots are formed in the same pass. Accordingly, even when a boundary is parallel to the main scanning direction, banding and a joint stripe cannot be generated. In this manner, dots forming a super cell region may have a triangular shape, or may have any of other polygonal shapes. Meanwhile, it is preferable that dots have a triangular or quadrilateral shape in order to make masses of dots have similar shapes. In addition, a smallest super cell region may be the same as a mass of dots having a minimum size. A plurality of super cell regions may have a shape in which M masses (M is an integer of 2 or greater) of dots having a minimum size are combined with each other.

MODIFICATION EXAMPLE

Although embodiments of the invention have been described so far based on several embodiments, these embodiments are given not for limiting the invention but only for easy understanding of the invention. Various modifications and improvements may be made without departing from the scope and spirit of the invention, and equivalents thereof are thus encompassed by the invention.

Modification Example 1

In the above-described embodiments, super cell regions have a polygonal shape. However, various other shapes can be adopted as the shape of the super cell region. For example, a boomerang shape, an arabesque shape, or a fractal shape may be used. The boomerang shape can be formed by combining three or five super cell regions SCS1 with each other.

Modification Example 2

In the above-described embodiments, although the number of passes N of multi-pass recording is two of 2 and 4, any integer of 2 or greater can be used as the number of passes N. In addition, a dot proportion in each main scanning pass can be set to any value as long as the sum of dot proportions on the main scanning lines based on N main scanning passes is set to 100%. In addition, it is preferable that positions of pixels in charge in N main scanning passes do not overlap each other. Meanwhile, in general, it is preferable that a feeding amount of sub-scanning performed after the termination of one main scanning pass is set to a fixed value which is equivalent to 1/N of a head height.

Modification Example 3

In addition, in the above-described embodiments, although it is described that a recording head moves in a main scanning direction, the invention is not limited to the above-mentioned configuration as long as ink can be ejected by relatively moving a recording medium and a recording head in a main scanning direction. For example, the recording medium may move in the main scanning direction in a state where the recording head is stopped, or both the recording medium and the recording head may move in the main scanning direction. Meanwhile, the recording medium and the recording head may also relatively move in a sub-scanning direction. For example, as in a flat head type printer, a head portion may move in an XY direction with respect to a recording medium mounted (fixed) on a table and may perform recording. That is, a configuration may also be adopted in which the recording medium and the recording head can move relatively in at least one of the main scanning direction and the sub-scanning direction.

Modification Example 4

In the above-described embodiments, a printer that ejects ink onto a printing sheet has been described. However, the invention can also be applied to various other dot recording apparatuses and can also be applied to, for example, an apparatus that forms dots by ejecting droplets onto a substrate. Further, a liquid ejecting apparatus that ejects or discharges a liquid other than ink may be adopted, and the invention can be applied to various liquid ejecting apparatuses that include a liquid ejecting head for ejecting a small amount of droplets. Meanwhile, the term "droplet" used herein refers to the state of a liquid to be ejected from the liquid ejecting apparatus, and includes a granular shape, a teardrop shape, and a tailed threadlike shape. In addition, the term "liquid" used herein may be a material that can be ejected from the liquid ejecting apparatus. For example, a material of a liquid phase is preferably used. A fluid state material, such as a liquid state material having high or low viscosity, sol, gel water, an inorganic solvent, an organic solvent, a solution, a liquid resin, or a liquid metal (metal melt), may be used. In addition to a liquid as one state of a material, a material, which is obtained by dissolving, dispersing, or mixing particles of function material containing solid material, such as pigment or metal particles, in a solvent, may be used. In addition, representative examples of the liquid include ink described in the above-described embodiments, liquid crystal, and the like. The term "ink" used herein includes various liquid compositions, such as aqueous ink, oil-based ink, gel ink, and hot-melt ink. Specific examples of the liquid ejecting apparatus include a liquid ejecting apparatus that ejects a liquid, in which a material, such as an electrode material or a color material, is dispersed or dissolved, and is used in manufacturing a liquid crystal display, an electroluminescence (EL) display, a field emission display, and color filters, a liquid ejecting apparatus that ejects a bioorganic material to be used in manufacturing a bio-chip, a liquid ejecting apparatus that ejects a liquid, serving as a sample, as a precision pipette, a textile printing apparatus, and a micro dispenser. In addition, a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, and a liquid ejecting apparatus that ejects an etchant, such as acid or alkali, to etch a substrate may be used. The invention may be applied to one of the liquid ejecting apparatuses.

What is claimed is:

1. A dot recording apparatus comprising:

a recording head that includes a plurality of nozzles;

a main scanning driving mechanism that performs a main scanning pass for forming dots on a recording medium while relatively moving the recording head and the recording medium in a main scanning direction;

a sub-scanning driving mechanism that performs sub-scanning for relatively moving the recording medium and the recording head in a sub-scanning direction that intersects the main scanning direction; and a control unit, the control unit performing multi-pass recording in which dot recording on a main scanning line is completed by N main scanning passes (N is a predetermined integer of 2 or greater), and the control unit controlling the recording head to perform dot recording in the N main scanning passes using a plurality of super cell regions that include m types (m is an integer of 2 or greater) of super cell regions having different sizes such that the super cell regions are formed as one dot group by some of the plurality of nozzles, and the control unit controlling the recording head to form, among the m types of the super cell regions, at least one type super cell regions during one of the N main scanning passes such that each of the at least one type super cell regions is formed by a plurality of the dots and has a plurality of boundary line portions dividing the each of at least one type super cell regions from adjacent super cell regions that are adjacent to the each of at least one type super cell regions and all of the boundary line portions of each of the at least one type super cell regions are not parallel to the main scanning direction and the sub-scanning direction.

2. The dot recording apparatus according to claim 1, wherein the m types of super cell regions include p smallest super cell regions (p is an integer of 1 or greater and has a value varying depending on a type of super cell region) on the basis of the smallest super cell region formed as one dot group by some of the plurality of nozzles.

3. The dot recording apparatus according to claim 2, wherein in dot recording in each main scanning pass, some of the plurality of super cell regions recorded in the same main scanning pass are formed by connecting masses of a plurality of dots, which have similar shapes and are recorded in the main scanning pass, to each other.

4. The dot recording apparatus according to claim 1, wherein the super cell regions include a first super cell region and a second super cell region that overlap each other in mutual boundaries.

5. The dot recording apparatus according to claim 4, wherein when the first super cell region is recorded by a first main scanning pass and the second super cell region is recorded by a second main scanning pass which is subsequent to the first main scanning pass, a ratio in charge of dot recording which is a ratio of the number of pixel positions at which dot recording is performed, as pixel positions belonging to the first super cell region, to the number of pixel positions at which dot recording is performed, as pixel positions belonging to the second super cell region, is set to gradually change from the first super cell region toward the second super cell region, in an intermediate region in which the first super cell region and the second super cell region overlap each other.

6. The dot recording apparatus according to claim 1, wherein when a boundary line of any of the individual super cell regions includes portions which are parallel to the main scanning direction, the parallel boundary line portions are recorded by the same pass.

7. The dot recording apparatus according to claim 1, wherein a value of the N is 4.

8. The dot recording apparatus according to claim 7, wherein the super cell regions have similar shapes.

9. A dot recording method comprising:

performing a main scanning pass for forming dots on a recording medium while relatively moving a recording head and the recording medium in a main scanning direction; and performing multi-pass recording in which formation of dots on a main scanning line is completed by N main scanning passes (N is a predetermined integer of 2 or greater), the performing of the multi-pass recording including performing dot recording in the N main scanning passes using a plurality of super cell regions that include m types of super cell regions having different sizes such that the super cell regions are formed as one dot group by some of the plurality of nozzles, and forming, among the m types of the super cell regions, at least one type super cell regions during one of the N main scanning passes such that each of the at least one type super cell regions is formed by a plurality of the dots and has a plurality of boundary line portions dividing the each of at least one type super cell regions from adjacent super cell regions that are adjacent to the each of at least one type super cell regions and all of the boundary line portions of each of the at least one type super cell regions are not parallel to the main scanning direction and a sub-scanning direction that intersects the main scanning direction.

10. A non-transitory computer readable storage medium storing a computer program, the computer program having a function of creating raster data for causing a dot recording apparatus to perform dot recording, the dot recording apparatus performing a main scanning pass for forming dots on a recording medium while relatively moving a recording head and the recording medium in a main scanning direction, and performing multi-pass recording in which recording of dots on a main scanning line is completed by N main scanning passes (N is a predetermined integer of 2 or greater), the raster data being data of a plurality of super cell regions that include m types of super cell regions having different sizes, the super cell region being formed as one dot group by some of the plurality of nozzles, the raster data being data of forming at least one type super cell regions, among the m types of the super cell regions, during one of the N main scanning passes such that each of the at least one type super cell regions is formed by a plurality of the dots and has a plurality of boundary line portions dividing the each of at least one type super cell regions from adjacent super cell regions that are adjacent to the each of at least one type super cell regions and all of the boundary line portions of each of the at least one type super cell regions are not parallel to the main scanning direction and the sub-scanning direction that intersects the main scanning direction.

* * * * *